US008732910B1

(12) United States Patent
Paul et al.

(10) Patent No.: US 8,732,910 B1
(45) Date of Patent: May 27, 2014

(54) APPLIANCE HANDLE ASSEMBLY

(71) Applicant: General Electric Company, Schenectady, NY (US)

(72) Inventors: Steven David Paul, Louisville, KY (US); Thomas S. Trupe, Inidanapolis, IN (US)

(73) Assignee: General Electric Companmy, Schenectady, NY (US)

( * ) Notice: Subject to any disclaimer, the term of this patent is extended or adjusted under 35 U.S.C. 154(b) by 0 days.

(21) Appl. No.: 13/780,210

(22) Filed: Feb. 28, 2013

(51) Int. Cl.

| | |
|---|---|
| ***E05B 1/00*** | (2006.01) |
| ***F25D 23/02*** | (2006.01) |
| ***A47B 95/02*** | (2006.01) |
| ***A47B 95/00*** | (2006.01) |

(52) U.S. Cl.
USPC ..... 16/413; 16/436; 16/444; 312/405

(58) Field of Classification Search
USPC ..... 16/412, 413, 415, 436, 444; 312/401, 312/405; 49/460
See application file for complete search history.

(56) References Cited

U.S. PATENT DOCUMENTS

| | | | | |
|---|---|---|---|---|
| 2,469,893 | A * | 5/1949 | Rockwell | 292/76 |
| 2,472,479 | A * | 6/1949 | Hoff | 16/413 |
| 3,426,385 | A * | 2/1969 | Gutshall | 16/412 |
| 3,621,510 | A * | 11/1971 | Rollins, Jr. | 16/422 |
| 4,127,353 | A | 11/1978 | Busse | |
| 5,303,451 | A | 4/1994 | Graviss et al. | |
| 5,308,574 | A | 5/1994 | Yamazaki et al. | |
| 5,553,354 | A * | 9/1996 | Trulaske, Sr. | 16/412 |
| 5,632,061 | A * | 5/1997 | Smith et al. | 16/444 |
| 5,632,062 | A * | 5/1997 | Katz et al. | 16/412 |
| 5,659,927 | A | 8/1997 | Shanok et al. | |
| 6,401,302 | B1 * | 6/2002 | Josserand et al. | 16/444 |
| 6,450,364 | B1 * | 9/2002 | Nam | 220/759 |
| 6,546,597 | B2 | 4/2003 | Atalla et al. | |
| 6,609,274 | B2 * | 8/2003 | Christensen et al. | 16/412 |
| 6,708,374 | B2 * | 3/2004 | Mandel | 16/436 |
| D552,959 | S | 10/2007 | Gilboe | |
| 7,458,133 | B2 | 12/2008 | Wing | |
| 7,520,543 | B2 * | 4/2009 | Purdy et al. | 292/336.3 |
| 7,527,307 | B2 * | 5/2009 | Belchine et al. | 292/336.3 |
| 7,549,713 | B2 * | 6/2009 | Gose et al. | 312/405 |
| 7,556,324 | B2 * | 7/2009 | Benz | 312/405 |
| 7,559,119 | B2 * | 7/2009 | Wing | 16/412 |
| 7,559,120 | B2 * | 7/2009 | Fujiwara et al. | 16/412 |
| D618,774 | S | 6/2010 | Bauer et al. | |
| 7,793,388 | B2 * | 9/2010 | Wing | 16/412 |
| 7,849,563 | B2 | 12/2010 | Wing | |
| 7,891,053 | B2 * | 2/2011 | Schuelke | 16/110.1 |
| 8,197,019 | B2 * | 6/2012 | Kim | 312/408 |
| 8,215,731 | B2 * | 7/2012 | Drach et al. | 312/405 |
| 8,328,250 | B2 * | 12/2012 | Botten et al. | 292/336.3 |

(Continued)

FOREIGN PATENT DOCUMENTS

| | | |
|---|---|---|
| DE | 3940137 A1 | 6/1991 |

*Primary Examiner* — Victor Batson
*Assistant Examiner* — Jason W San
(74) *Attorney, Agent, or Firm* — Dority & Manning, P.A.

(57) ABSTRACT

A handle assembly that may be used on an appliance is provided. The handle assembly can include a handle that is received into one or more receptacles and can be installed without tools or the use of additional fasteners such as screws, bolts, and the like. The handle assembly can be installed onto doors, drawers, or other components of a variety of different appliance types.

18 Claims, 10 Drawing Sheets

(56) References Cited

U.S. PATENT DOCUMENTS

| | | | | |
|---|---|---|---|---|
| 2005/0161461 | A1* | 7/2005 | Shin et al. | 220/752 |
| 2006/0113312 | A2* | 6/2006 | Shin et al. | 220/752 |
| 2008/0034553 | A1 | 2/2008 | Wing | |
| 2008/0127458 | A1 | 6/2008 | Ramsauer | |
| 2010/0005631 | A1 | 1/2010 | Drach et al. | |
| 2012/0106182 | A1* | 5/2012 | Minter et al. | 362/501 |
| 2012/0280608 | A1* | 11/2012 | Park et al. | 312/405 |

* cited by examiner

APPLIANCE HANDLE ASSEMBLY

FIELD OF THE INVENTION

The present disclosure relates generally to a handle assembly for a residential or commercial appliance.

BACKGROUND OF THE INVENTION

Known residential and commercial appliances, such as refrigerators, generally include a housing that defines one or more compartments for storage of items to be refrigerated and/or frozen. Exterior and interior doors and/or drawers can be provided for accessing these compartments. One or more handles are typically provided for manipulating these doors. Fasteners may be used to attach the handles or, in other constructions, the handles may be formed integrally.

For certain applications, shipping the appliance without one or more of the handles installed may be desirable. In the case of handles located on the exterior of the appliance, for example, shipping the appliance with the handle already installed can increase the footprint of the appliance. Additionally, installed handles can increase the amount of packaging materials required for protecting the appliance during shipping. For instance, a handle that protrudes from the surface may need special packaging to prevent damage during shipping.

Challenges exist, however, with providing one or more handles to be installed by the retailer or purchaser of the appliance. Commonly used handle constructions may require tools and/or skills that the retailer or purchaser may not possess. The installation process may require multiple steps and the presence of more than one person. Such factors may lead the retailer or purchaser to incorrectly install the handle or not even attempt installation, which in turn can lead to service calls and/or dissatisfaction with the product.

Also, where the handle assembly requires multiple parts, particularly small fasteners such as screws, bolts, and washers, such parts are typically shipped with the product. Unfortunately, this requires additional steps during manufacture and packaging. Additionally, such parts may be lost by the retailer or purchaser prior to, or during, installation.

Accordingly, a handle assembly for an appliance that can be shipped with the appliance uninstalled would be useful. A handle assembly with features that allow for installation without the use of tools and/or multiple small parts would also be useful. Such a handle assembly that can be used on a door, drawer, or component of a variety of different appliance types would be particularly beneficial.

BRIEF DESCRIPTION OF THE INVENTION

The present invention provides a handle assembly that may be used on an appliance. The handle assembly can be installed without tools or the use of additional fasteners such as screws, bolts, and the like. The handle assembly can be installed onto doors, drawers or other components of a variety of different appliance types. Additional aspects and advantages of the invention will be set forth in part in the following description, or may be apparent from the description, or may be learned through practice of the invention.

In one exemplary embodiment, the present invention provides a handle assembly configured for mounting to a wall of an appliance. The wall defines normal, lateral, and transverse directions that are orthogonal to each other. The wall also defines a least one aperture. The handle assembly includes a receptacle positioned along an interior side of the wall of the appliance. The receptacle includes a receptacle cavity and at least one receptacle locking member. The receptacle locking member projects into the receptacle cavity along the lateral direction and defines a receptacle locking surface that extends along a transverse direction and a receptacle guiding surface that extends along the normal direction. A handle is positioned along an exterior side of the wall of the appliance. The handle includes a key that extends along the normal direction, through the aperture of the wall of the appliance, and into the receptacle cavity. The key defines a key locking surface that extends along the transverse direction and a key guiding surface that extends along the normal direction. The key locking surface is positioned substantially parallel to, and in contact with, the receptacle locking surface when the handle is installed.

In another exemplary embodiment, the present invention provides a slide-on handle assembly for an appliance, the appliance having a wall defining at least one aperture and defining a direction normal to the wall. The handle assembly includes a handle defining at least two keys spaced apart from each other along the lateral direction. Each key extends along the normal direction through the aperture in the wall and into the receptacle cavity. Each key defines at least one key locking member positioned at a distal end of the key and projecting along a lateral direction. The assembly also includes a receptacle defining a receptacle cavity and a pair of opposing side walls spaced apart from each other along the lateral direction. Each opposing side wall includes a plurality of receptacle locking members extending along the lateral direction into the receptacle cavity. The receptacle also defines guiding grooves and locking grooves with each of the guiding grooves and locking grooves positioned adjacent to at least one of the receptacle locking members. At least one of the key locking members is positioned in one of the locking grooves to fix the position of the handle on the wall of the appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

The use of the same or similar reference numerals in the figures is used to denote the same or similar features.

DETAILED DESCRIPTION OF THE INVENTION

Figure 1:
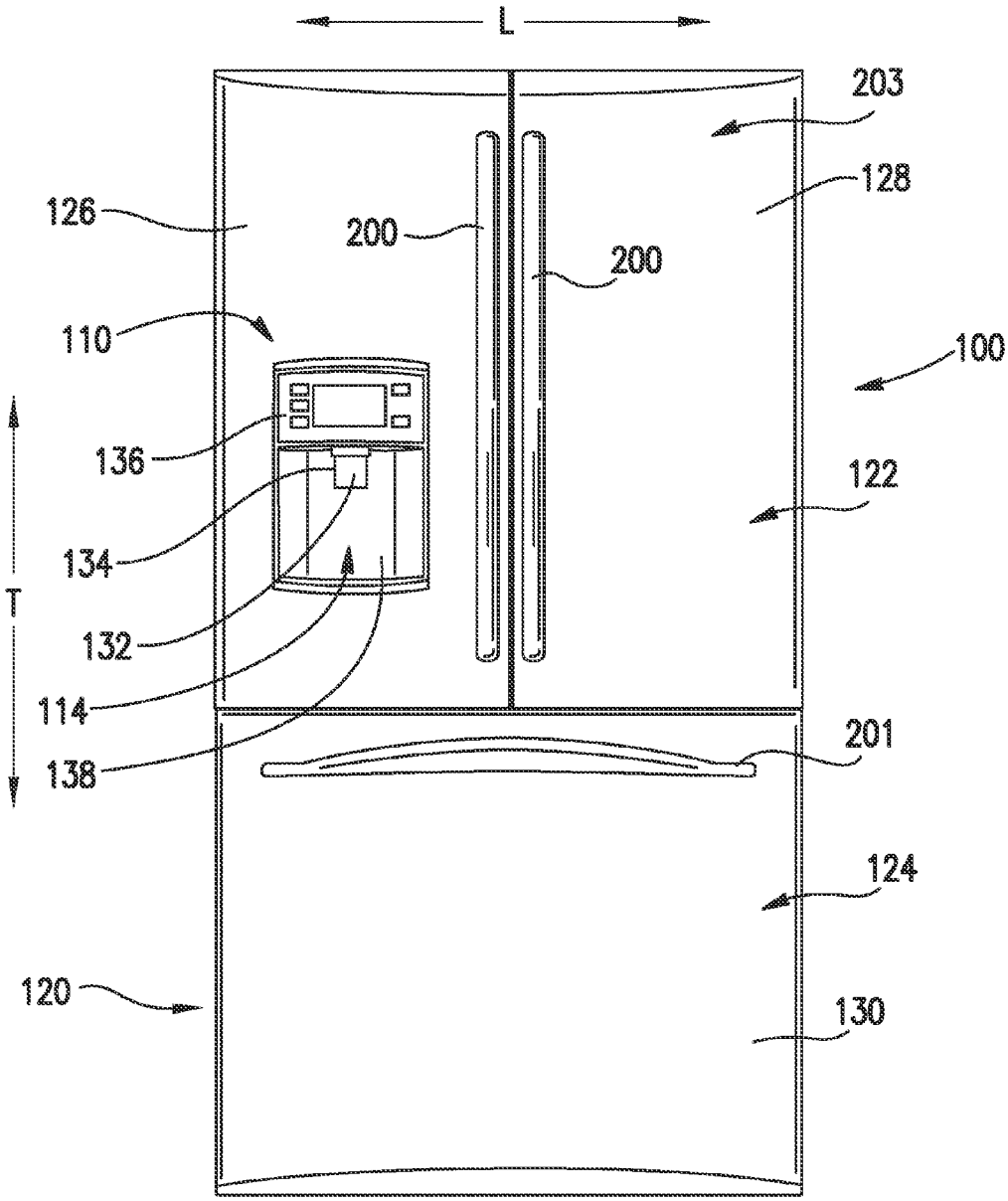
FIG. 1 provides a front view of an exemplary embodiment of a refrigerator appliance of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a front view of a refrigerator 100 that includes an ice-dispensing assembly 110 for dispensing water and/or ice. In this exemplary embodiment, ice-dispensing assembly 110 includes a dispenser 114 positioned on an exterior portion of refrigerator 100. Refrigerator 100 includes a cabinet 120 having an upper fresh food compartment 122 and a lower freezer compartment 124 arranged at the bottom of refrigerator 100. As such, refrigerator 100 is generally referred to as a bottom mount refrigerator. In the exemplary embodiment, cabinet 120 also defines a mechanical compartment (not shown) for receipt of a cooling system. Using the teachings disclosed herein, one of skill in the art will understand that the present invention can be used with other types of appliances such as, for example, side-by-side refrigerators, freezers, ovens, and others as well. Consequently, the description set forth herein is for illustrative purposes only and is not intended to limit the invention in any aspect.

Refrigerator doors 126, 128 are rotatably hinged to an edge of cabinet 120 for accessing fresh food compartment 122. A freezer door 130 is arranged below refrigerator doors 126, 128 for accessing freezer compartment 124. In the exemplary embodiment, freezer door 130 is coupled to a freezer drawer (not shown) slidably coupled within freezer compartment 124. Handles 200 and 201 may be used for manipulation of doors 126, 128, and 130. Handles 200 and 201, for example, are positioned onto a wall (e.g., wall 203) or surfaces forming doors 126, 128, and 130. Further description of the installation and construction of e.g., handles 200 is provided below.

For this exemplary embodiment, dispenser 114 includes a discharging outlet 132 for accessing ice and water. A single paddle 134 is mounted below discharging outlet 132 for operating dispenser 114. A user interface panel 136 is provided for controlling the mode of operation. For example, user interface panel 136 may include a water dispensing button (not labeled) and an ice-dispensing button (not labeled) for selecting a desired mode of operation such as crushed or non-crushed ice.

Discharging outlet 132 and paddle 134 are an external part of dispenser 114, and are mounted in a concave portion 138 defined in an outside surface of refrigerator door 126. Concave portion 138 is positioned at a predetermined elevation convenient for a user to access ice or water enabling the user to access ice without the need to bend-over and without the need to access freezer compartment 124. In the exemplary embodiment, concave portion 138 is positioned at a level that approximates the chest level of a user.

Figure 2:
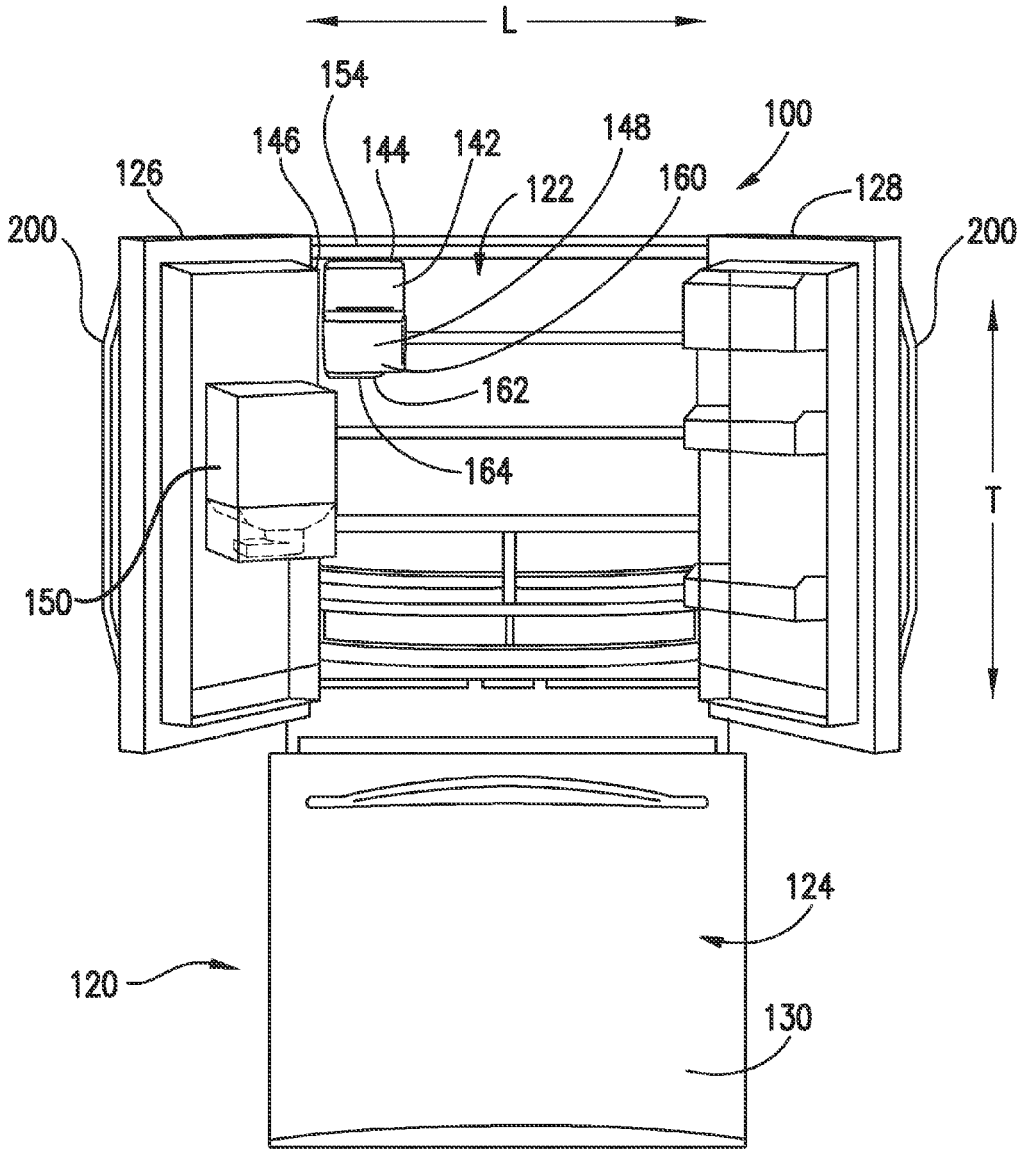
FIG. 2 is front view of the exemplary appliance of FIG. 1 with doors to a fresh food compartment shown in an open position.

FIG. 2 is a perspective view of refrigerator 100 having doors 126, 128 in an open position to reveal the interior of the fresh food compartment 122. As such, certain components of this exemplary embodiment of the ice dispensing assembly 110 are illustrated. Ice-dispensing assembly 110 includes an insulated housing 142 mounted within refrigerator compartment 122 along an upper surface 144 of compartment 122 and along a sidewall 146 of compartment 122. Insulated housing 142 includes insulated walls 148 defining an insulated cavity (not shown). Due to the insulation which encloses the cavity, the temperature within the cavity can be maintained at levels different from the temperature in the surrounding fresh food compartment 122.

In this exemplary embodiment, the insulated cavity is constructed and arranged to operate at a temperature that facilitates producing and storing ice. More particularly, the insulated cavity contains an ice maker for creating ice and feeding the same to a container 150 that is mounted on refrigerator door 126. As illustrated in FIG. 2, container 150 is placed at a vertical position on refrigerator door 126 that will allow for the receipt of ice from a discharge opening 162 located along a bottom edge 164 of insulated housing 142. Other configurations for the location of ice container 150, an ice maker, and/or insulated housing 142 may be used as well.

Operation of the refrigerator 100 can be regulated by a controller (not shown) that is operatively coupled to user interface panel 136 and/or paddle 134. Panel 136 provides selections for user manipulation of the operation of refrigerator 100 such as e.g., selections between whole or crushed ice, chilled water, and/or other options as well. In response to user manipulation of the user interface panel 136, the controller operates various components of the refrigerator 100. The controller may include a memory and one or more microprocessors, CPUs or the like, such as general or special purpose microprocessors operable to execute programming instructions or micro-control code associated with operation of refrigerator 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout refrigerator 100. In the illustrated embodiment, the controller may be located within the control panel area of door 126. In such an embodiment, input/output ("I/O") signals may be routed between the controller and various operational components of refrigerator 100 such as a motor for rotating components of an ice crusher as will be described further below. In one embodiment, the user interface panel 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads.

The user interface 136 may include a display component, such as a digital or analog display device designed to provide operational feedback to a user. The user interface 136 may be in communication with the controller via one or more signal lines or shared communication busses.

The exemplary door handle assembly of the present invention includes a handle that mates with a receptacle in a complementary manner and with a wall or surface of an appliance positioned at least partially therebetween. The wall may form part of a door, drawer, or other compartment in the appliance. The handle is inserted into the receptacle and slides into a fixed position to secure the handle onto the appliance. By way of example, FIGS. 3, 4, 5, 6, and 7 provide certain views of an exemplary embodiment of a handle 200 of the present invention. FIGS. 8, 9, 10, and 11 provide an exemplary embodiment of a receptacle 250 of the present invention. As shown in the figures, handle assembly comprising handle 200 and receptacle 250 defines a normal direction N, a lateral direction L, and a transverse direction T—which are each orthogonal to one another.

Figure 3:
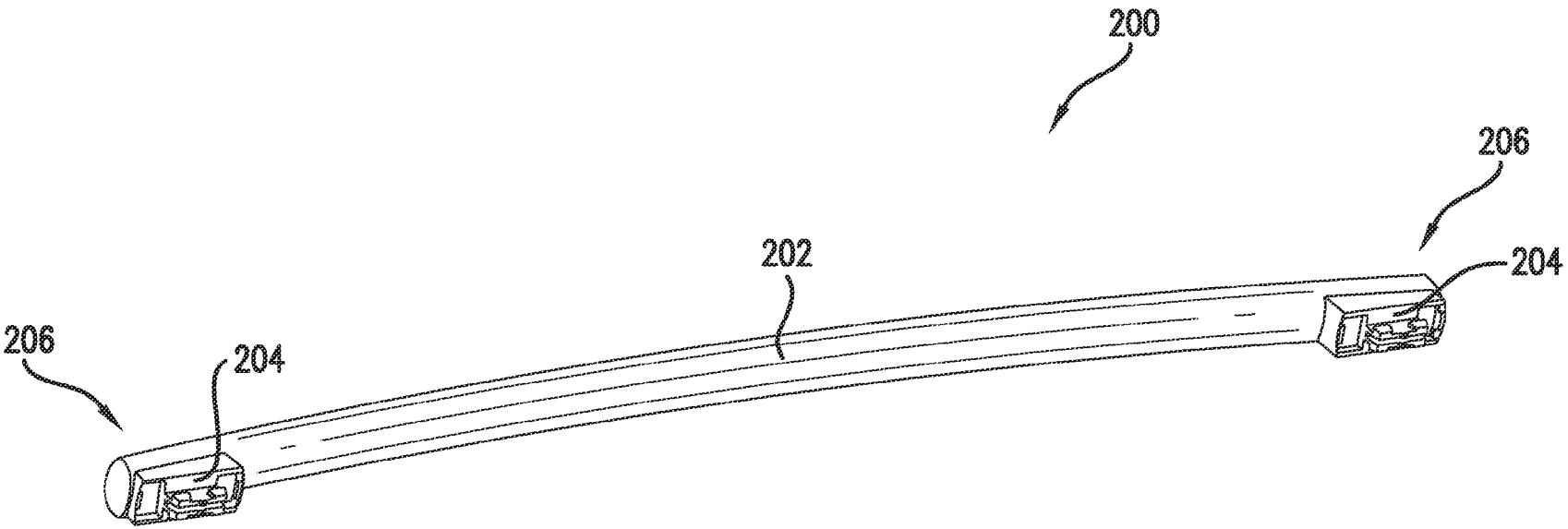
FIG. 3 is a perspective view of an exemplary embodiment of a handle of the present invention as may be used with the appliance of FIGS. 1 and 2.

FIG. 3 provides a perspective of the exemplary handle 200, which includes a beam 202 extending between distal ends 206. The shape, including length and width, of handle 200 is provided by way of example only. Other shapes and sizes may be used as well.

Figure 4:
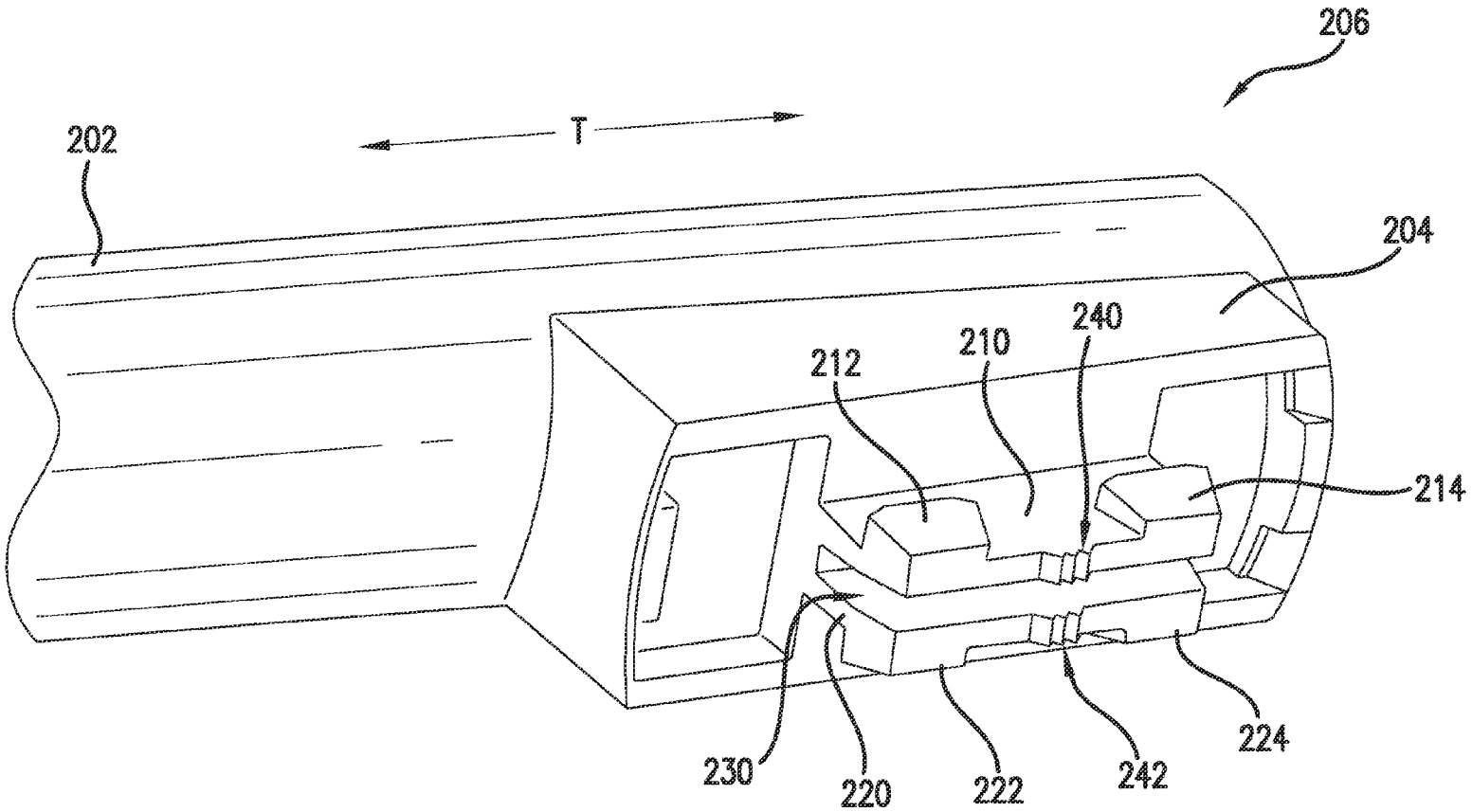
FIG. 4 provides a perspective view of one end of the exemplary handle of FIG. 3.
Figure 5:
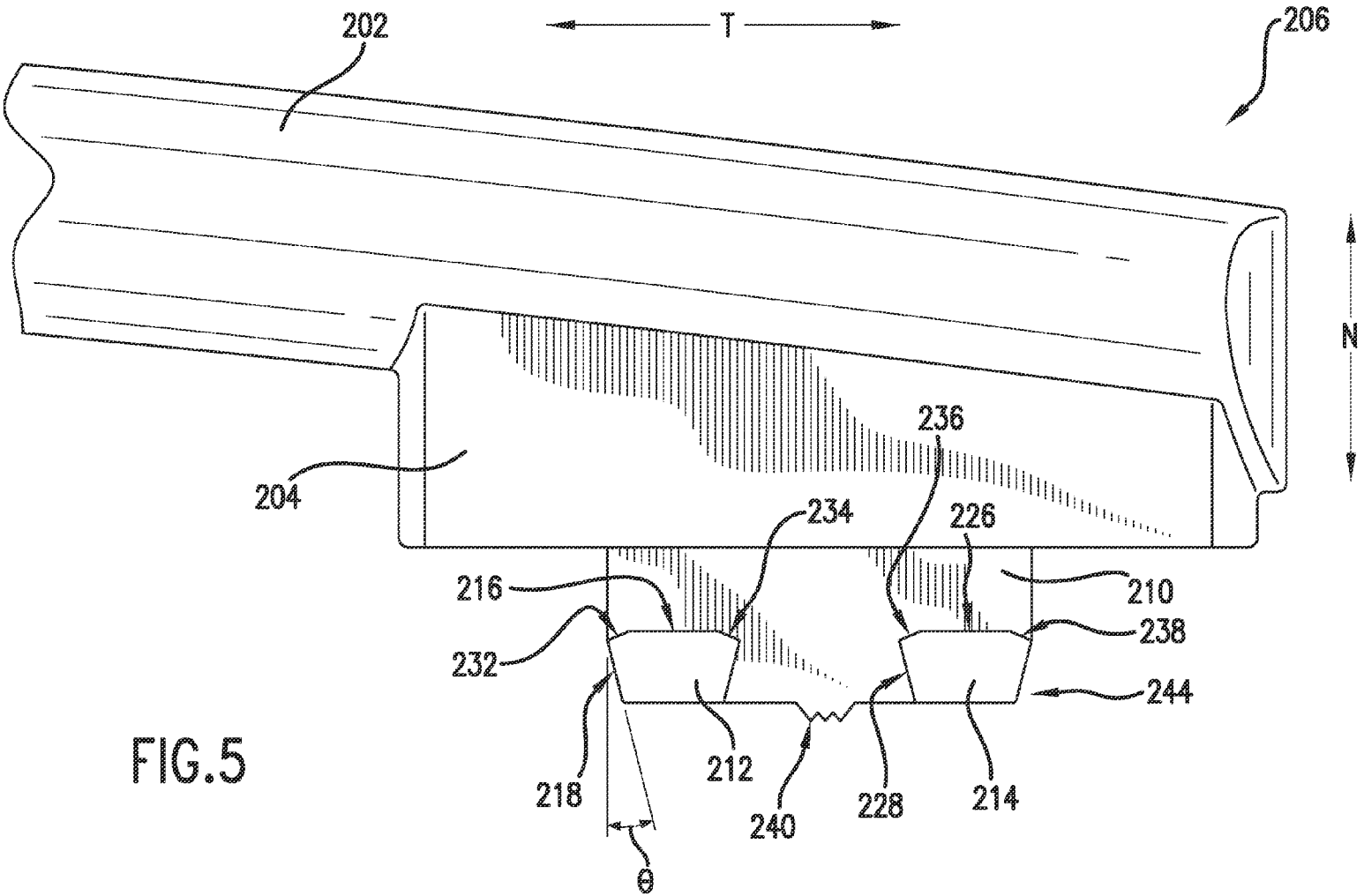
FIG. 5 is a side view of the end of the exemplary handle of FIGS. 3 and 4.
Figure 6:
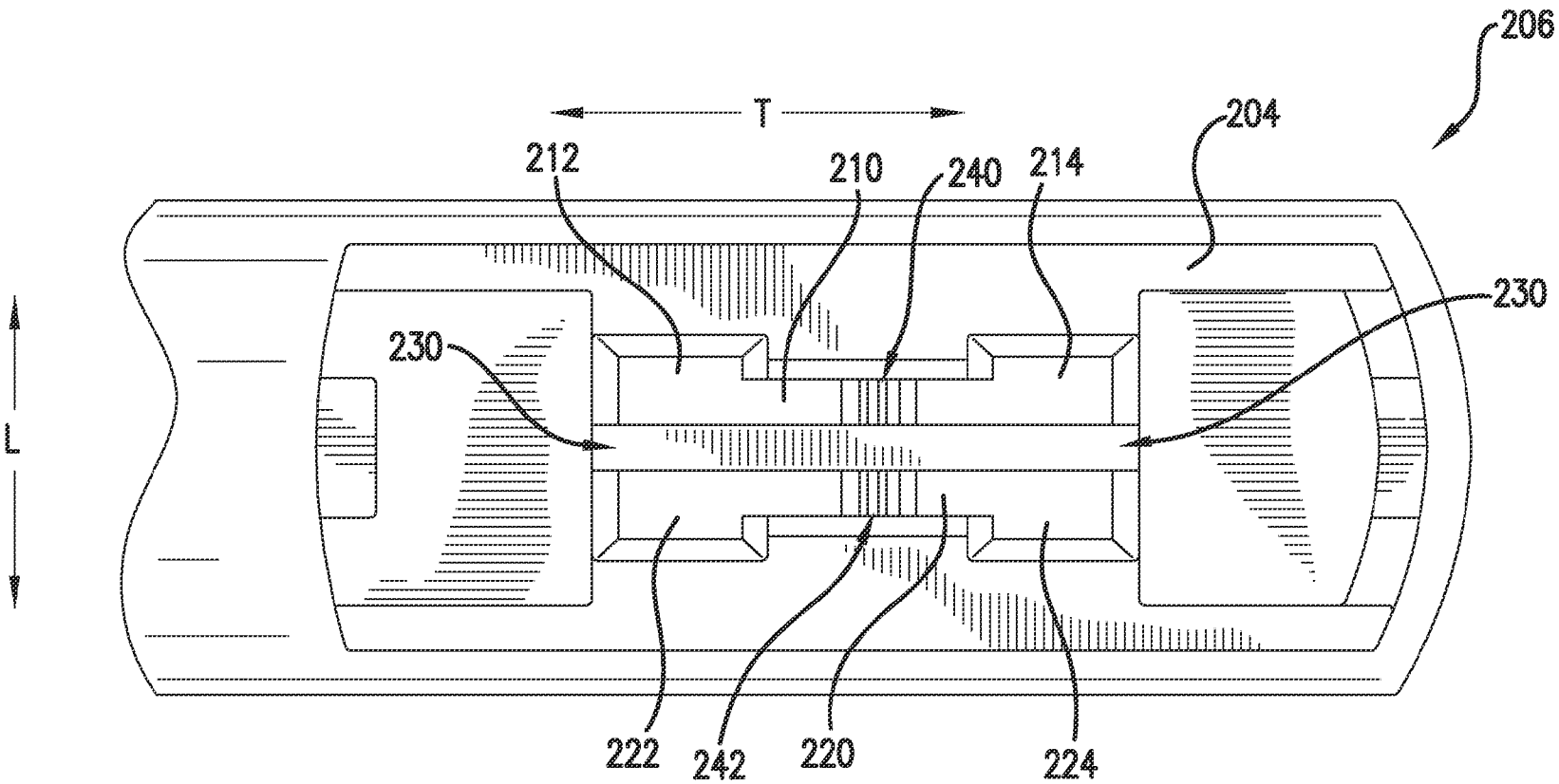
FIG. 6 is a rear or bottom view of the exemplary handle of FIGS. 3, 4, and 5.
Figure 7:
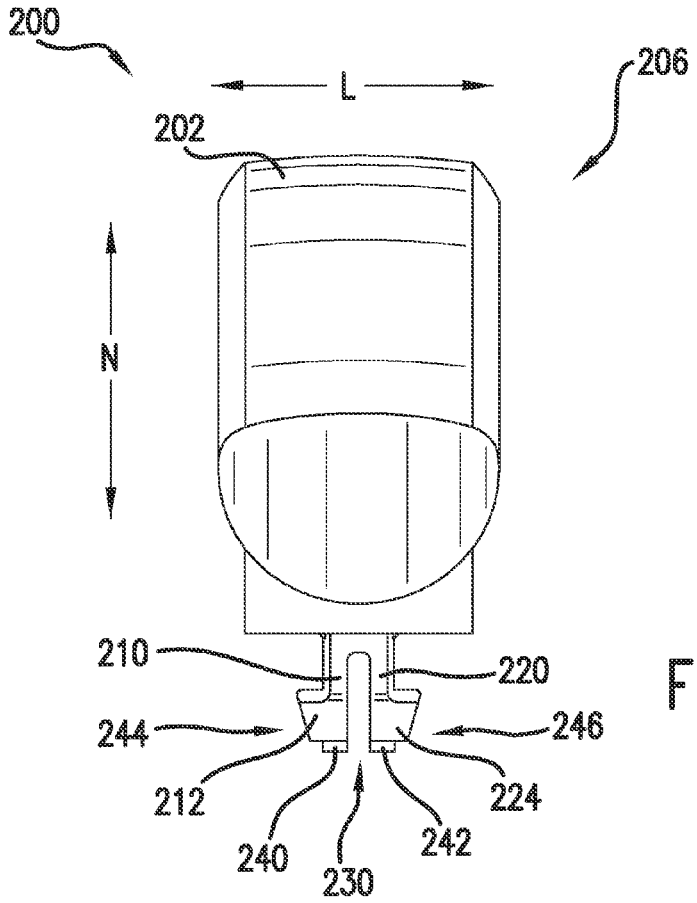
FIG. 7 is an end view of the exemplary handle of FIGS. 3, 4, 5, and 6.
Figure 8:
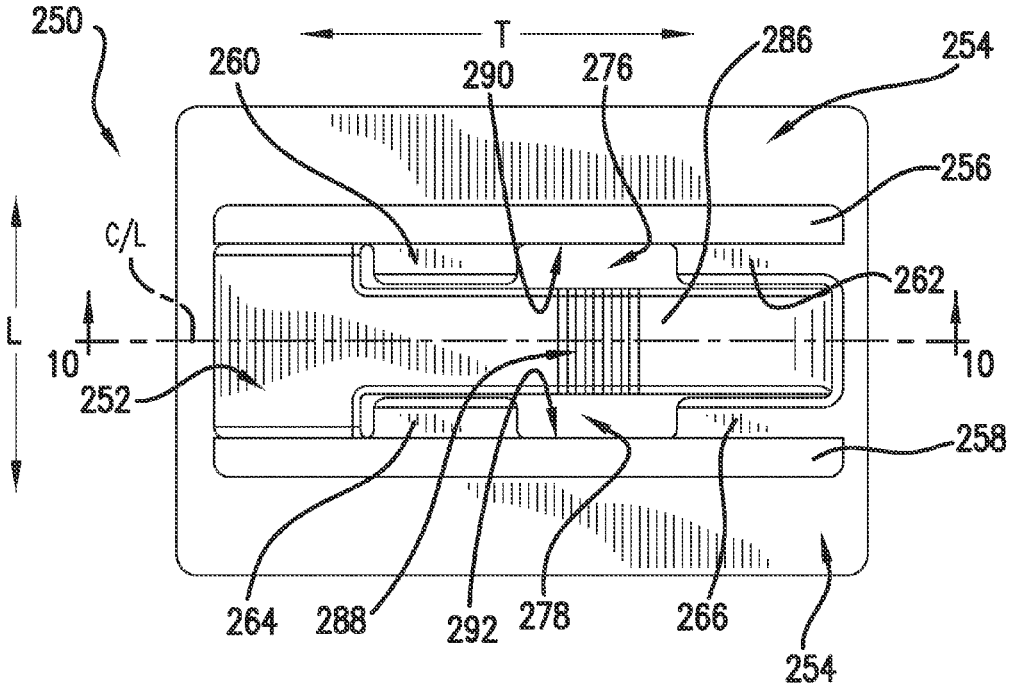
FIG. 8 is a top view of an exemplary embodiment of a receptacle as may be used with the exemplary handle of FIGS. 3, 4, 5, 6, and 7.

Each distal end 206 of handle 200 includes a base 204 from which at least one key 210 extends along a normal direction N as shown more particularly in FIGS. 4, 5, 6, and 7. For this exemplary embodiment of handle 200, a pair of keys 210 and 220 are shown extending along the normal direction N from each distal end 206 of handle 200. Using the teachings disclosed herein, one of skill in the art will understand that one, two, or more keys may be used at one or both distal ends 206 in other embodiments of the invention. Each key 210, 220 extends along normal direction N through an aperture 208 (FIGS. 11 and 12) in the wall 203 of appliance 100 and into a receptacle 250—the construction of which will be more fully described herein. Keys 210 and 220 are spaced apart from each other along lateral direction L by a groove 230 that extends longitudinally along transverse direction T as best seen in FIGS. 4 and 6. Groove 230, for example, allows keys 210 to flex toward each other along lateral direction L as such are being installed into receptacle 250.

Key 210 defines key locking members 212 and 214, which are each positioned at distal end 244 (FIG. 7) of key 210 and project therefrom along lateral direction L. Key 220 defines key locking members 222 and 224, which are positioned at distal end 246 (FIG. 7) of key 220 and also project therefrom along lateral direction L but in an opposing manner from locking members 212 and 214. For the exemplary embodiment of handle 200 shown in the figures, each key is shown to include a pair of key locking members. Using the teachings disclosed herein, one of skill in the art will understand that one, two, or more key locking members may be used with each key in other embodiments of the invention.

Referring now to FIG. 5, key locking member 212 of key 210 defines a key locking surface 216 that extends along the transverse direction T and a key guiding surface 218 that extends along the normal direction N. Key locking surface 216 includes chamfered corners 232 and 234. Key locking member 214 of key 210 defines a key locking surface 226 that extends along the transverse direction T and a key guiding surface 228 that extends along the normal direction N. Key locking surface 226 includes chamfered corners 236 and 238. For this exemplary embodiment, keys 210 and 220 are symmetrical about groove 230 and, therefore, key locking members 222 and 224 will also be understood to each define at least one key locking surface and key guiding surface in a manner similar to key locking members 212 and 214.

In a manner that will be further described, keys 210 and 220 are received into a receptacle 250, which is illustrated in FIGS. 8, 9, 10, and 11. More specifically, receptacle 250 defines a receptacle cavity 252 that is configured for receipt of keys 210 and 220. Receptacle cavity 252 is defined in part by a pair of opposing side walls 290 and 292 that are spaced apart from each other along the lateral direction L.

For this exemplary embodiment of the handle assembly, opposing side wall 290 includes a plurality of receptacle locking members 260 and 262 that extend along lateral direction L into the receptacle cavity 252. Similarly, opposing side wall 292 includes a plurality of receptacle locking members 264 and 266 that also extend along lateral direction L into the receptacle cavity 252 and towards opposing side wall 290. Although two receptacle locking members are shown on each of the opposing side walls 290 and 292, in other embodiments of the invention one, two, or more receptacle locking members may be used on either or both of the opposing side walls 290, 292. The number of receptacle locking members and associated features may be selected depending upon, for example, the number of key locking members on each key of handle 200.

Figure 10:
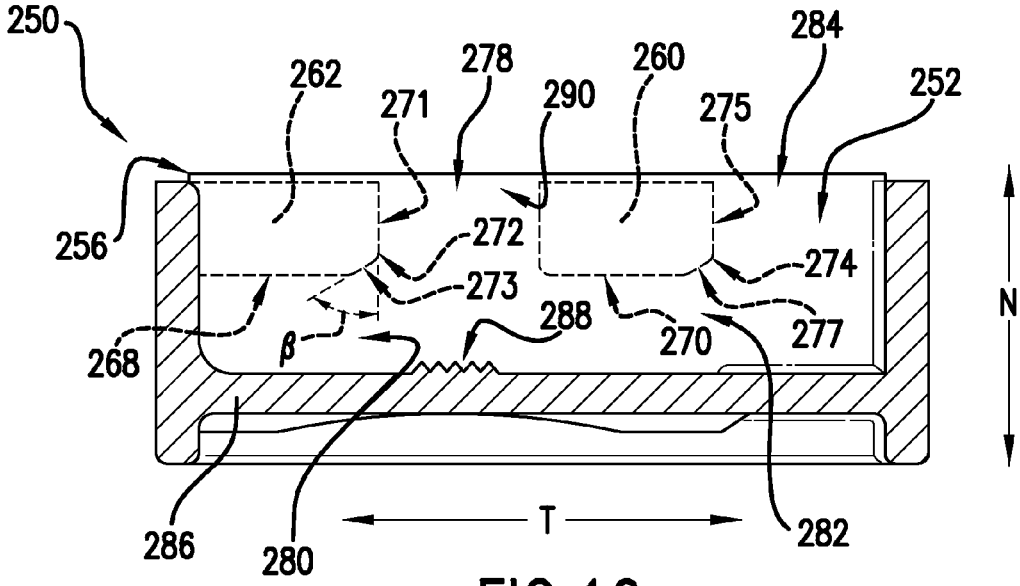
FIG. 10 is a side cross-sectional view of the exemplary receptacle of FIG. 8.

Referring now to the cross-sectional view of receptacle 250 shown in FIG. 10, features along opposing side wall 290 will now be further described. As receptacle 250 is symmetrical about center line C/L (FIG. 8) for this exemplary embodiment, it will be understood that opposing side wall 292 contains similar features. As shown in FIG. 10, receptacle locking member 260 defines a receptacle locking surface 270 and receptacle locking member 262 defines a receptacle locking surface 268. In addition, receptacle 250 also defines receptacle locking groove 282 adjacent to receptacle locking member 260 and receptacle locking groove 280 adjacent to receptacle locking member 262. Receptacle locking grooves 280 and 282 are configured for receipt of key locking members 212 and 214 when handle 200 is installed in receptacle 250 so as to fix the position of handle 200 onto the wall 203 of appliance 200.

Figure 9:
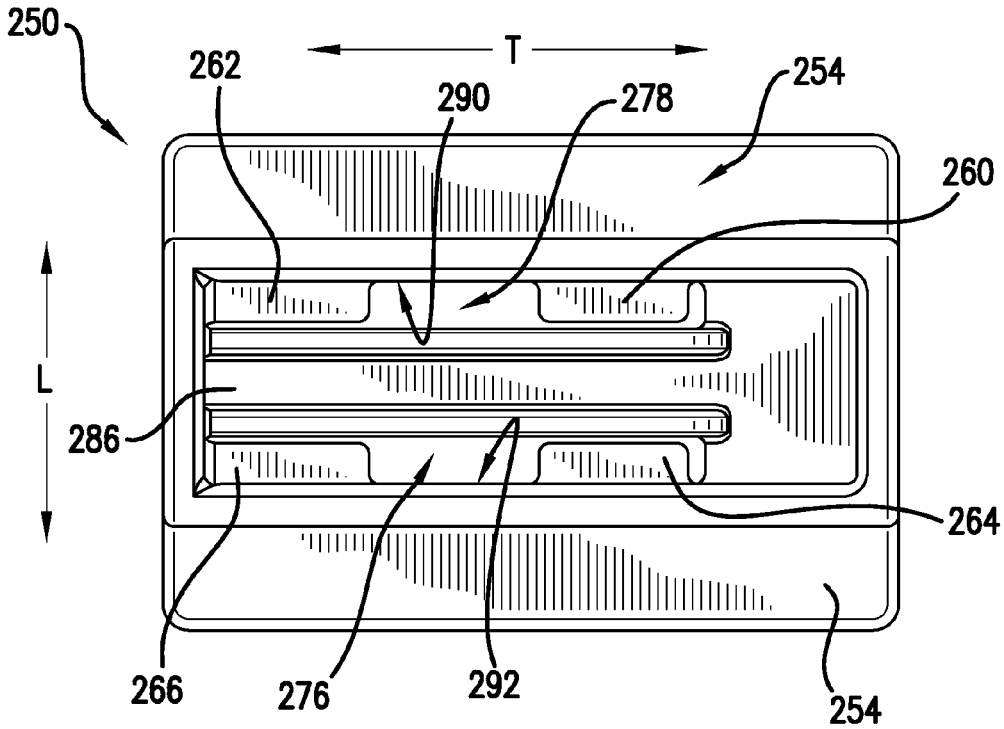
FIG. 9 is a bottom view of the exemplary receptacle of FIG. 8.

Continuing with FIG. 10, receptacle 250 also defines guiding grooves 278 and 284, which are positioned adjacent to receptacle locking members 262 and 260, respectively. More specifically, guiding groove 278 is positioned adjacent receptacle guiding surface 272, which has a first portion 271 parallel to normal direction N and a second portion 273 that is at a non-zero, acute angle β to normal direction N. Similarly, guiding groove 284 is positioned adjacent receptacle guiding surface 274, which has a first portion 275 parallel to normal direction N and a second portion 277 that is also at a non-zero, acute to normal direction N. Opposing wall 292 has features similar to wall 290 as previously described. For example, FIG. 9 shows guiding groove 276 opposite to guiding groove 278.

Figure 11:
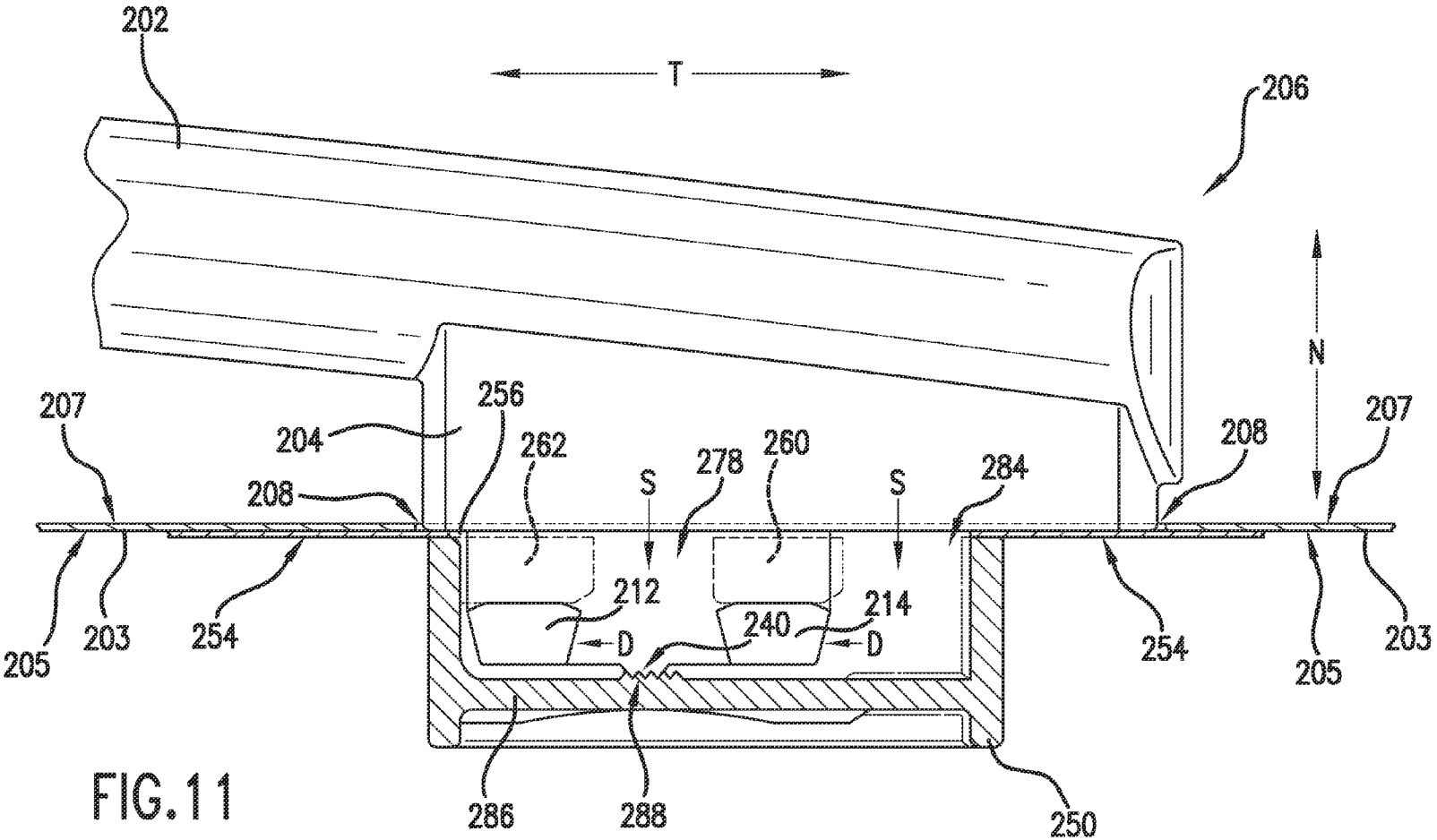
FIG. 11 is a side view and partial cross-sectional view of the exemplary handle of FIG. 3 installed in the exemplary receptacle of FIG. 8.

FIG. 11 provides a side view of one distal end 206 of handle 200 installed in receptacle 250 with wall 203 of appliance 100 positioned therebetween—it being understood that the other distal end 206 would be installed similarly onto wall 203 in a companion receptacle 250. In FIG. 11, receptacle 250 is shown in cross-section to more clearly reveal certain aspects of this exemplary embodiment of the invention. As such, the installation of handle 200 will be described with reference to key locking members 212 and 214 of key 210—it being understood the installation of key 220 and its locking members into receptacle 250 would be similar.

During installation, handle 200 is manipulated so that keys 210 and 220 are inserted through one or more openings or apertures 208 defined by wall 203. Apertures 208 are located along wall 203 or other surface of the appliance depending where handle 200 is to be located. Keys 210 and 220 are inserted through aperture 208 along normal direction N so that e.g., key locking members 212 and 214 are received into guiding grooves 278 and 284. Key locking members 212 and 214 slide along grooves 278 and 284, as indicated by arrows S, while receptacle guiding surface 272 (FIG. 10) simultaneously contacts key guiding surface 218 (FIG. 5) and receptacle guiding surface 274 (FIG. 10) contacts key guiding surface 228 (FIG. 5). Key guiding surfaces 218 and 228 can be configured at a non-zero, acute angle from normal direction N to help facilitate the insertion of keys 210 and 220. For example, as shown in FIG. 5, angle β could be in a range between 0 and about 25 degrees—other values may be used as well.

Once keys 210 and 220 are fully inserted into receptacle 250, handle 200 is then manipulated so that keys 210 and 220 are moved along transverse direction T as indicated by arrows D. This movement causes key locking members 212 and 214 to move along locking grooves 280 and 282 (FIG. 10), respectively, until seated in the installed position shown in FIG. 11. The non-zero, acute angle β between the second portions 273 and 277 of receptacle guiding surfaces 272 and 274 (FIG. 10) and the normal direction N aids the transition of key locking members 212 and 214 into locking grooves 280 and 282. For example, as shown in FIG. 10, angle β could be in a range between 40 and 80 degrees—other values may be used as well. Chamfered corners 232 and 236 (FIG. 5) facilitate this movement as well.

A variety of different features may be used to secure handle 200 once installed into the position shown in FIG. 11. By way of example, receptacle 250 includes a beam 286 that extends along the transverse direction T and is spaced apart along the normal direction N from wall 203 of the appliance 200. Beam 286 includes a first locking element in the form of a plurality of teeth 288 extending along normal direction N. Teeth 288 engage with a second locking element in the form of a plurality of teeth 240 and/or plurality of teeth 242 on keys 210 and 220 so as to fix the position of handle 200 along the transverse direction T. Beam 286 may be formed of e.g., a resilient material that allows beam 286 to slightly flex along normal direction N as handle 200 is slid along transverse direction T into the installed position shown in FIG. 11.

The locking of handle 200 into place secures handle 200 onto the wall 203 of appliance 200 by trapping wall 203 between handle 200 and one or more receptacles 250 positioned at distal ends 206. Each receptacle 250 may be held in place against the interior surface 205 of wall 203 by insulation, fasteners, and or other features. Accordingly, during e.g., manufacture and shipping, receptacle 250 is held into position adjacent aperture 208 so that handle 200 may be installed by a retailer or purchaser without the use of special tools. Because handle 200 can be installed after shipping, the footprint and/or packaging materials required for shipping appliance 100 can be reduced.

As mentioned, other features may be used to fix the position of handle 200. By way of example, teeth could be placed on one or more of the receptacle locking surfaces to engage with teeth on one or more of the key locking surfaces. Alternatively, or in addition thereto, interference fits and other features could also be used.

As described above, after insertion (arrows S in FIG. 11) of handle 200 into receptacle 250 along normal direction N, handle 200 is slid (arrows D in FIG. 11) along transverse direction T to snap or lock handle 200 into place. Features can be provided so as to eliminate or reduce the movement of handle 200 (particularly base 204) against an exterior surface 207 of wall 203, which might scratch or mar surface 207. For example, referring to FIGS. 8 and 11, receptacle 250 includes a flange 254 that extends around a least a portion of receptacle cavity 252. Flange 254 is positioned against the interior surface 205 of wall 203. A pair of protrusions 256 and 258 are positioned on opposing sides of receptacle cavity 252 as shown. As best seen in FIG. 11, protrusions 256 and 258 extend through opening 208 in wall 203 to make contact with the base 204 of handle 200 as it is slid into position—thereby preventing base 204 from damaging the exterior surface 207 during installation.

Figure 12:
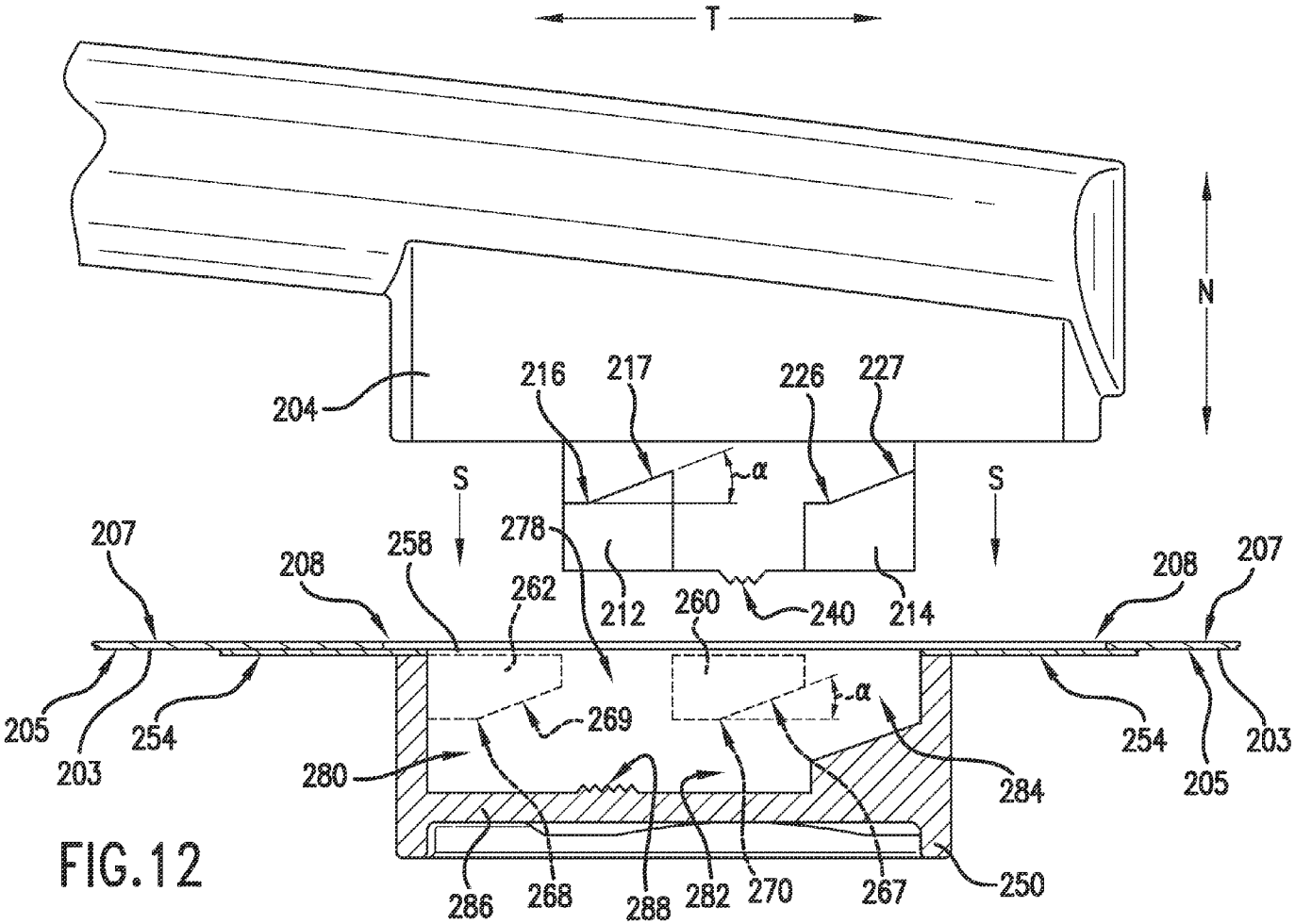
FIG. 12 is a side view and partial cross-sectional view of another exemplary embodiment of a handle and receptacle—or handle assembly—of the present invention.

FIG. 12 provides additional exemplary embodiments of a handle 200 and receptacle 250 for a slide-on handle assembly of the present invention. Receptacle 250 is shown in a cross-sectional view similar to FIG. 11. For this exemplary embodiment, key locking members 212 and 214 include key locking surfaces 216 and 226. Key locking surface 216 includes a portion 217 that is at a non-zero, acute angle α from the transverse direction T. Key locking surface 226 includes a similar portion 227.

In a complementary manner, receptacle locking members 260 and 262 include receptacle locking surfaces 268 and 270 having portions 267 and 269 that are also at angle α. Accordingly, handle 200 is positioned into receptacle 250 along guiding grooves 278 and 284 and is then fixed into position in locking grooves 280 and 282 with key locking members 212 and 214 engaging receptacle locking members 262 and 260, respectively.

FIG. 12 is provided by way of example only. Receptacle and key locking members of still other shapes and configurations different from that shown in the figures may be used as well.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A handle assembly configured for mounting to a wall of an appliance, the handle assembly defining normal, lateral, and transverse directions that are orthogonal to each other, the handle assembly comprising:

a receptacle for positioning along an interior side of the wall of the appliance, the receptacle comprising:

a receptacle cavity defined at least in part by a pair of opposing side walls that are spaced apart along the lateral direction and extend along the normal direction;

at least one receptacle locking member projecting from one of the opposing side walls into the receptacle cavity along the lateral direction and defining a receptacle locking surface that extends along a transverse direction and a receptacle guiding surface that extends along the normal direction; and a handle for positioning along an exterior side of the wall of the appliance, the handle comprising a base;

a key that extends from the base along the normal direction, through an aperture of the wall of the appliance, and into the receptacle cavity;

the key comprising a distal end spaced apart from the base along the normal direction and further comprising a key locking member projecting along the lateral direction from the distal end of the key, the key locking member defining a key locking surface that extends along the transverse direction and a key guiding surface that extends along the normal direction, wherein the key locking surface is positioned substantially parallel to, and in contact with, the receptacle locking surface when the handle is installed into the receptacle.

2. A handle assembly as in claim 1, wherein the receptacle cavity defines a guiding groove positioned adjacent to the receptacle guiding surface that is configured for sliding receipt of the key locking member as the handle is installed onto the wall of the appliance.

3. A handle assembly as in claim 1, wherein the receptacle cavity defines a locking groove positioned adjacent to the receptacle locking surface and configured for receipt of the key locking member when the handle is installed onto the wall of the appliance.

4. A handle assembly as in claim 1, wherein the receptacle further comprises a beam that extends along the transverse direction and is spaced apart along the normal direction from an interior surface of the appliance wall.

5. A handle assembly as in claim 4, further comprising:

a first locking element positioned on the beam; and a second locking element positioned on the key, the first locking element and second locking element engaging each other to secure the position of the key in the receptacle along the transverse direction.

6. A handle assembly as in claim 4, further comprising:

a first plurality of teeth extending from the beam along the normal direction; and a second plurality of teeth positioned on the key and extending along the normal direction, the first and second plurality of teeth engaging each other to secure the position of the key in the receptacle along the transverse direction.

7. A handle assembly as in claim 4, wherein the beam comprises a resilient material and is configured so as to flex along the normal direction as the key is positioned into the receptacle.

8. A handle assembly as in claim 1, wherein the receptacle defines a flange extending around at least a portion of the receptacle cavity, the flange positioned against an interior surface of the appliance wall.

9. A handle assembly as in claim 8, wherein the flange defines a pair of protrusions positioned on opposing sides of the receptacle cavity, the protrusions extending into the aperture in the appliance wall and positioned in contact with the handle.

10. A handle assembly as in claim 1, wherein the receptacle guiding surface includes a first portion that is parallel to the normal direction and a second portion that is at a nonzero, acute angle to the normal direction.

11. A handle assembly as in claim 1, wherein the receptacle comprises a pair of opposing side walls, wherein the receptacle locking member extends along the lateral direction from at least one of the opposing side walls.

12. A slide-on handle assembly for an appliance, the handle assembly defining normal, lateral, and transverse directions that are orthogonal to each other, the handle assembly comprising:

a receptacle configured for positioning along an interior side of a wall of the appliance, the receptacle defining a receptacle cavity formed at least in part by a pair of opposing side walls spaced apart from each other along the lateral direction and extending along the normal direction, each opposing side wall comprising a plurality of receptacle locking members projecting from the opposing side wall along the lateral direction into the receptacle cavity, the receptacle also defining guiding grooves and locking grooves, each of the guiding grooves and locking grooves positioned adjacent to at least one of the receptacle locking members; and a handle comprising a base and at least two keys spaced apart from each other along the lateral direction and extending from the base along the normal direction, the two keys configured for extending through an aperture in the wall of the appliance and into the receptacle cavity, each key defining at least one key locking member positioned at a distal end of the key and projecting along the lateral direction, wherein at least one of the key locking members is positioned in one of the locking grooves for fixing the position of the handle on the wall of the appliance.

13. A slide-on handle assembly for an appliance as in claim 12, wherein the handle further comprises a groove extending along the transverse direction between the at least two keys.

14. A slide-on handle assembly for an appliance as in claim 12, the receptacle further comprising a beam that extends along the transverse direction, the beam engaging at least one of the key locking members so as to fix the position of the handle along the transverse direction.

15. A slide-on handle assembly for an appliance as in claim 12, further comprising:

a first locking element positioned on the receptacle;

a second locking element positioned on at least one of the keys, the locking elements configured for engaging each other so as to secure the position of the handle along the transverse direction.

16. A slide-on handle assembly for an appliance as in claim 12, wherein the receptacle locking members each comprise a receptacle guiding surface that includes a first portion that is parallel to the normal direction and a second portion that is at a non-zero, acute angle to the normal direction.

17. A slide-on handle assembly for an appliance as in claim 12, wherein the receptacle defines a flange extending around at least a portion of the receptacle cavity, the flange positioned against an interior surface of the appliance wall.

18. A slide-on handle assembly for an appliance as in claim 17, wherein the flange defines a pair of protrusions positioned on opposing sides of the receptacle cavity, the protrusions extending into the aperture in the appliance wall and positioned in contact with the handle.

* * * * *